US012791028B2

(12) United States Patent
Yamaguchi

(10) Patent No.: US 12,791,028 B2
(45) Date of Patent: Nov. 10, 2026

(54) VACUUM PUMP, PROTECTIVE NET, AND CONTACT PART

(71) Applicant: Edwards Japan Limited, Chiba (JP)

(72) Inventor: Toshiki Yamaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 177 days.

(21) Appl. No.: 18/916,075

(22) Filed: Oct. 15, 2024

(65) Prior Publication Data

US 2025/0035116 A1 Jan. 30, 2025

Related U.S. Application Data

(62) Division of application No. 17/287,301, filed as application No. PCT/JP2019/041795 on Oct. 24, 2019, now abandoned.

(30) Foreign Application Priority Data

Oct. 31, 2018 (JP) ..... 2018-204847

(51) Int. Cl.
*F04D 27/02* (2006.01)
*F04C 29/12* (2006.01)
(Continued)

(52) U.S. Cl.
CPC ..... *F04C 29/12* (2013.01); *F04D 29/701* (2013.01); *F04C 2220/10* (2013.01);
(Continued)

(58) Field of Classification Search
CPC .... F04D 29/701; F04D 29/604; F04D 19/044; F04D 27/0292; F04D 27/008
(Continued)

(56) References Cited

U.S. PATENT DOCUMENTS 5,154,572 A 10/1992 Toyoshima et al.
7,572,096 B2 * 8/2009 Nonaka ..... F04D 19/04 415/200
(Continued)

FOREIGN PATENT DOCUMENTS

DE 102005052792 B4 12/2017
JP H01123138 8/1989
(Continued)

OTHER PUBLICATIONS

PCT International Search Report dated Jan. 21, 2020 for corresponding PCT application Serial No. PCT/JP2019/041795, pages.
(Continued)

*Primary Examiner* — Deming Wan
(74) *Attorney, Agent, or Firm* — Theodore M. Magee; Westman, Champlin & Kochler, P.A.

(57) ABSTRACT

A vacuum pump that is small in height (length) is configured to bring a rotating body and a protective net as close to each other as possible by causing the rotating body to actively support the protective net. The vacuum pump is provided with a mechanism that causes a rotating body (a shaft or a rotor) to actively support a protective net when the protective net becomes deformed (bent) toward the vacuum pump side due to a change in pressure or temperature of the vacuum pump. Specifically, instead of preventing the protective net from being caught in the rotating body by increasing the distance therebetween, the entanglement of the protective net is prevented by actively supporting the protective net by bringing the protective net and the rotating body closer to each other. Accordingly, the height (length) of the vacuum pump can be reduced more.

5 Claims, 16 Drawing Sheets

(51) Int. Cl.

| | |
|---|---|
| ***F04D 19/04*** | (2006.01) |
| ***F04D 27/00*** | (2006.01) |
| ***F04D 29/70*** | (2006.01) |
| *F04D 1/00* | (2006.01) |
| *F04D 13/06* | (2006.01) |

(52) U.S. Cl.
CPC ..... *F04C 2230/91* (2013.01); *F04C 2240/20* (2013.01); *F04C 2240/80* (2013.01); *F04D 1/00* (2013.01); *F04D 13/06* (2013.01); *F04D 19/04* (2013.01)

(58) Field of Classification Search
USPC ..... 137/550; 415/90, 88, 169.1, 169.2
See application file for complete search history.

(56) References Cited

U.S. PATENT DOCUMENTS

| | | | | |
|---|---|---|---|---|
| 8,308,427 | B2 | 11/2012 | Tsutsui | |
| 9,016,995 | B1 | 4/2015 | Janowicz, Sr. et al. | |
| 2003/0017047 | A1 | 1/2003 | Shiokawa et al. | |
| 2006/0110271 | A1* | 5/2006 | Klabunde ..... | F04D 29/701 417/423.4 |
| 2013/0115094 | A1 | 5/2013 | Kabasawa | |
| 2013/0230384 | A1 | 9/2013 | Okudera et al. | |
| 2015/0204353 | A1 | 7/2015 | Kogame | |
| 2021/0355966 | A1 | 11/2021 | Yamaguchi | |

FOREIGN PATENT DOCUMENTS

| | | | |
|---|---|---|---|
| JP | H02196192 | A | 8/1990 |
| JP | 09075643 | A | 3/1997 |
| JP | H11247790 | A | 9/1999 |
| JP | 2001059496 | A | 3/2001 |
| JP | 2005344512 | A | 12/2005 |
| JP | 5064264 | B2 | 10/2012 |
| WO | 2008139614 | A1 | 11/2008 |
| WO | 2010064321 | A1 | 6/2010 |

OTHER PUBLICATIONS

PCT International Written Opinion dated Jan. 21, 2020 for corresponding PCT application Serial No. PCT/JP2019/041795, 5 pages.
File history of corresponding U.S. Appl. No. 17/287,301 including: Office Action dated Jul. 29, 2024, Amendment dated Jul. 2, 2024, Final Office Action dated Apr. 23, 2024, Amendment dated Mar. 22, 2024, Office Action dated Jan. 18, 2024, Amendment dated Dec. 22, 2023 and Office Action dated Nov. 7, 2023, 86 pages.

* cited by examiner

VACUUM PUMP, PROTECTIVE NET, AND CONTACT PART

CROSS-REFERENCE OF RELATED APPLICATION

The present application is a divisional of and claims priority of U.S. patent application Ser. No. 17/287,301, filed Apr. 21, 2021, the content of which is hereby incorporated by reference in its entirety, which is a Section 371 National Stage Application of International Application No. PCT/JP2019/041795, filed Oct. 24, 2019, which is incorporated by reference in its entirety and published as WO 2020/090633 A1 on May 7, 2020 and which claims priority of Japanese Application No. 2018-204847, filed Oct. 31, 2018.

BACKGROUND OF THE INVENTION

The present invention relates to a protective net provided at an inlet port of a vacuum pump, and to a technique for preventing the protective net from being caught in a rotating body when, for example, the pressure inside the vacuum pump changes significantly, by providing, between the rotating body and the protective net, a portion where the rotating body and the protective net come into contact with each other and that holds the protective net.

In a vacuum pump 1 such as a turbomolecular pump or a thread groove pump, a protective net 100 for preventing foreign matter from entering the vacuum pump 1 is provided at an inlet port 4 side.

FIGS. 16A and 16B are diagrams for explaining the protective net 100 and a place in the inlet port 4 where the protective net is installed. The protective net 100 has a shape in which a large number of hexagonal holes are provided in a grid pattern, wherein the distance between the sides of each hexagonal hole that face each other is approximately 5 mm. As shown in the drawing, installing the protective net 100 at the inlet port 4 can prevent foreign matter from accidentally entering the inside of the vacuum pump 1.

Note that the shape and size of the mesh of the protective net 100 are not limited to those described above; various shapes and sizes exist depending on the assumed sizes of foreign matter and the like.

Incidentally, during the operation of the vacuum pump 1, the internal pressure and temperature of the vacuum pump 1 often change for some reason. Under such circumstances, the protective net 100 is affected by such changes in the pressure or temperature, and consequently a central portion thereof may become deformed (bent) toward the inside of the vacuum pump 1, as shown by the dotted line in the drawing. Since a rotor 8 of the vacuum pump 1 rotates at high speed, there exists a risk that the rotor 8 may come into contact with the deformed protective net 100 and catch the protective net 100.

In view of such risk, the protective net 100 itself can be made thicker and stronger in order to reduce the deformation (bending) of the protective net 100. However, making the protective net 100 thicker leads to a reduced conductance of the vacuum pump 1, adversely affecting the exhaust performance of the vacuum pump 1.

Therefore, the vacuum pump 1 has a design requirement for making the protective net 100 as thin as possible.

For this reason, in the prior art shown in FIG. 16B, a gap X exceeding the assumed maximum deflection amount Y of the protective net 100 (X>Y) is provided between the protective net 100 and the rotating body (shaft 7 or rotor 8) to prevent the protective net 100 from being caught in the rotating body.

In addition, various suggestions have conventionally been made in regard to the technique for preventing the protective net 100 from being caught.

The vacuum pump disclosed in Japanese Patent No. 5064264 is configured to prevent the protective net from being caught in the rotating body by making the distance between the protective net and the rotating body increase gradually as the protective net approaches the rotating shaft of the rotating body.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

However, as illustrated in the prior art, providing the gap X between the protective net 100 and the rotor 8 results in an increase in the height (length) of the vacuum pump 1 itself. Such configuration of the prior art is against the demand of a user demanding for a vacuum pump that is designed to be as compact as possible without compromising the exhaust performance thereof.

An object of the present invention, therefore, is to provide a vacuum pump that is small in height (length) and is configured to bring the rotating body and the protective net as close to each other as possible by causing the rotating body to actively support the protective net.

The present invention is a vacuum pump comprising a housing in which an inlet port is formed, a protective net provided at the inlet port, a gas transfer mechanism provided with a rotating body in the housing, and an entanglement prevention mechanism that prevents the protective net from being caught in the rotating body when the protective net is deformed.

A further embodiment includes the vacuum pump above wherein the entanglement prevention mechanism has a contact support structure in which, when the protective net is deformed, the protective net and the rotating body are brought into contact with each other to support each other.

A further embodiment includes the vacuum pump above wherein the contact support structure forms, in a part of the rotating body that comes into contact with the protective net, a shape having a small contact resistance.

A further embodiment includes the vacuum pump above wherein the shape having a small contact resistance is provided on a shaft of the rotating body.

The present invention is a vacuum pump wherein the shape having a small contact resistance is provided on a rotor of the rotating body.

A further embodiment includes the vacuum pump above wherein a part of the protective net that comes into contact with the rotating body is provided with a hole corresponding to the shape having a small contact resistance that is formed in the part of the rotating body.

A further embodiment includes the vacuum pump above wherein the hole provided on the protective net is configured to narrow a contact point coming into contact with the shape having a small contact resistance that is formed on the rotating body.

A further embodiment includes the vacuum pump above wherein the shape having a small contact resistance that is formed on the rotating body is coated so as to lower a friction coefficient.

A further embodiment includes the vacuum pump above wherein the part of the protective net that comes into contact with the rotating body is provided with a plane corresponding to the shape having a small contact resistance that is formed on the rotating body.

A further embodiment includes the vacuum pump above wherein a distance between the hole provided on the protective net and the shape having a small contact resistance that is formed on the rotating body is made smaller than a mesh of the protective net.

A further embodiment includes the vacuum pump above wherein the entanglement prevention mechanism is a non-mesh portion that is formed in a part of the protective net that comes into contact with the rotating body, by leaving a base material.

A further embodiment includes a protective net that is provided at an inlet port of a vacuum pump including a housing in which the inlet port is formed, and a gas transfer mechanism provided with a rotating body in the housing, the protective net including an entanglement prevention structure that prevents the protective net from being caught in the rotating body at the time of deformation.

A further embodiment is a contact part that is installed in a vacuum pump including a housing in which an inlet port is formed, a protective net provided at the inlet port, and a gas transfer mechanism provided with a rotating body in the housing, the contact part being installed in a part of the rotating body that comes into contact with the protective net when the protective net is deformed, and having a shape configured to have a small contact resistance.

According to the present invention, actively supporting the protective net from the rotating body side can prevent the protective net from being caught in the rotating body and reduce the distance therebetween, whereby the height of the vacuum pump can be reduced.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIG. 7 is a diagram for explaining an embodiment in which the contact point (contact portion) of the rotating body of Embodiment 1 and the contact point (protrusion) of Embodiment 2 are configured with separate members;

DESCRIPTION OF THE PREFERRED EMBODIMENTS

(i) Overview of Embodiments

A vacuum pump 1 according to embodiments of the present invention is provided with a mechanism that causes a rotating body (a shaft 7 or a rotor 8) to actively support a protective net 100 when the protective net 100 becomes deformed (bent) toward the vacuum pump 1 due to a change in pressure or temperature of the vacuum pump 1.

Specifically, instead of preventing the protective net 100 from being caught in the rotating body by increasing the distance therebetween, the entanglement of the protective net 100 is prevented by actively supporting the protective net 100 by bringing the protective net 100 and the rotating body closer to each other. Accordingly, the height (length) of the vacuum pump 1 can be reduced more.

In addition, the protective net 100, too, may be provided with such entanglement prevention mechanism.

(ii) Details of Embodiments

Preferred embodiments of the present invention are described hereinafter in detail with reference to FIGS. 1 to 15.

Configuration of Vacuum Pump 1

Figure 1:
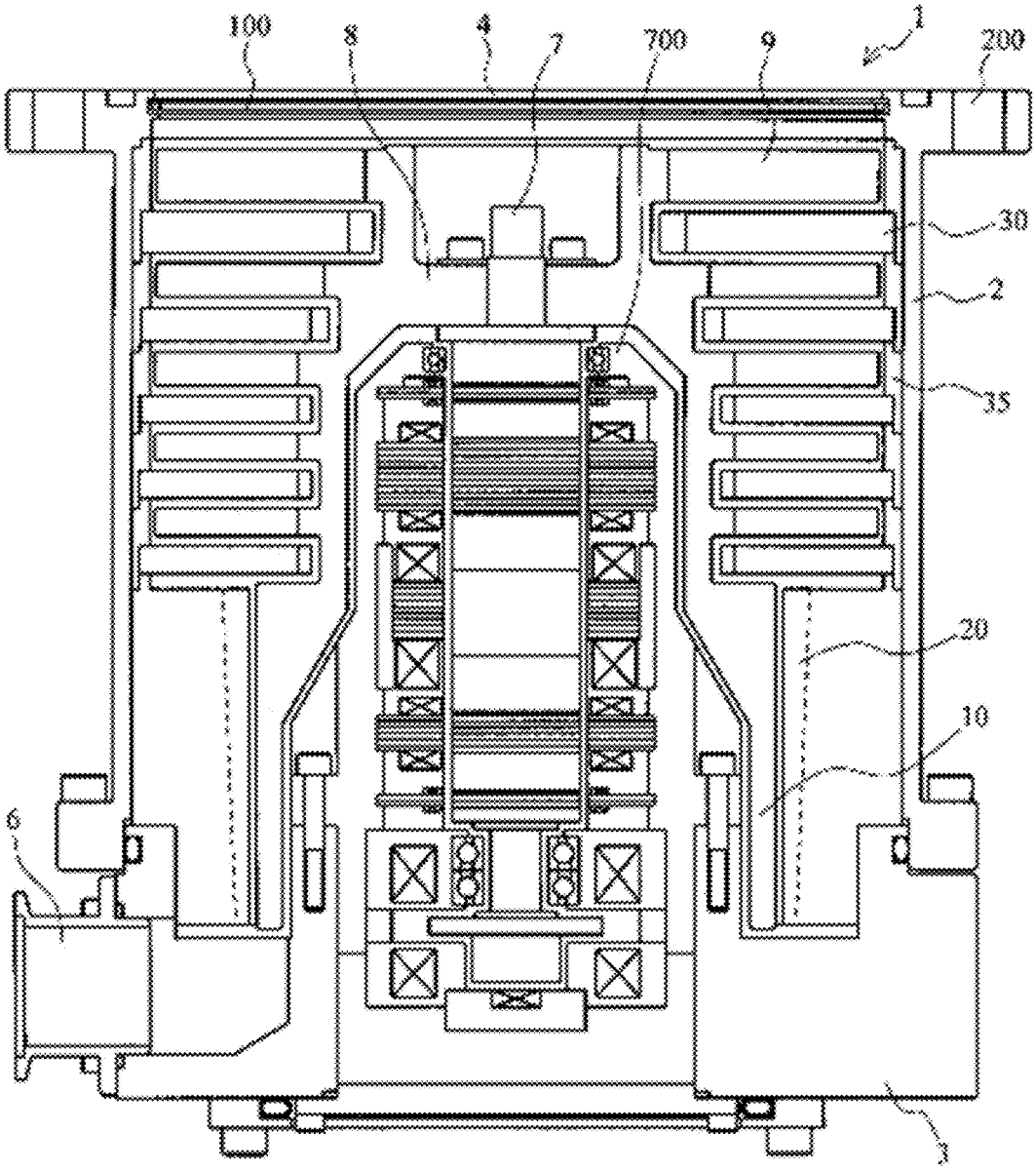
FIG. 1 is a diagram showing an example of a schematic configuration of a vacuum pump according to an embodiment of the present invention.

FIG. 1 is a diagram showing an example of a schematic configuration of the vacuum pump 1 according to a first embodiment of the present invention, the diagram showing a cross section of the vacuum pump 1 taken along an axial direction thereof.

Note that, for the sake of convenience, the embodiments of the present invention each describe a direction of a diameter of each rotor blade as "radial (diameter/radius) direction" and a direction perpendicular to the direction of the diameter of each rotor blade as "axial direction".

A casing (outer cylinder/case) 2 configuring a housing of the vacuum pump 1 has a substantially cylindrical shape and constitutes a case of the vacuum pump 1 together with a base 3 provided in a lower portion of the casing 2 (at an outlet port 6 side). A gas transfer mechanism, which is a structure bringing about an exhaust function of the vacuum pump 1, is accommodated in the case.

In the present embodiment, the gas transfer mechanism is composed of a rotating body (the rotor 8, rotor blades 9/rotor cylindrical portion 10, etc.) supported rotatably and a stator portion (stator blades 30/thread groove exhaust element 20, etc.) fixed to the case.

Although not shown, a controller for controlling the operation of the vacuum pump 1 is connected to the outside of the housing of the vacuum pump 1 by a dedicated line.

An inlet port 4 for introducing gas into the vacuum pump 1 is formed at an end portion of the casing 2. An inlet port flange portion 200 protruding toward an outer periphery of the casing 2 is formed on an end surface of the casing 2 at the inlet port 4 side.

A protective net 100 for preventing foreign matter from entering the vacuum pump 1 is provided at a lower portion of the inlet port 4. The protective net 100 is fixed to the casing 2 by bolts or a snap ring.

The outlet port 6 for exhausting the gas from the vacuum pump 1 is formed on the downstream side of the vacuum pump 1.

The rotating body includes the shaft 7 which is the rotating shaft, the rotor 8 disposed on the shaft 7, a plurality of rotor blades 9 provided on the rotor 8, and a rotor cylindrical portion (skirt portion) 10 provided on the outlet port 6 side.

The rotor blades 9 are each composed of a member extending radially so as to be perpendicular to the axis of the shaft 7.

The rotor cylindrical portion 10 is composed of a cylindrical member having a cylindrical shape which is concentric with a rotation axis of the rotor 8.

Although not shown in detail, in a stator column 700, a motor portion for rotating the shaft 7 at high speeds is provided in the middle of the shaft 7 in the axial direction thereof. Radial magnetic bearing devices for supporting the shaft 7 in the radial direction in a non-contact manner are provided at the inlet port 4 side and the outlet port 6 side with respect to the motor portion. Furthermore, an axial magnetic bearing device for supporting the shaft 7 in the axial direction in a non-contact manner is provided at a lower end of the shaft 7.

The stator blades 30 are formed on an inner peripheral side of the casing (case) 2. The stator blades 30 are fixed and separated by cylindrical stator blade spacers 35.

Note that the rotor blades 9 and the stator blades 30 are arranged alternately and formed in a plurality of stages in the axial direction, and, in order to fulfill the exhaust performance required for the vacuum pump 1, any number of rotor parts and stator parts can be provided as needed.

In the vacuum pump 1 according to the present embodiment, the thread groove exhaust element 20 (thread groove exhaust mechanism) is disposed at the outlet port 6 side. Thread grooves (spiral grooves) are formed on a surface of the thread groove exhaust element 20 that faces the rotor cylindrical portion 10. An alternative configuration is possible in which the thread grooves are formed on a surface of the rotor cylindrical portion 10 that faces the thread groove exhaust element 20.

The surface of the thread groove exhaust element 20 that faces the rotor cylindrical portion 10 (i.e., the inner peripheral surface parallel to the axis of the vacuum pump 1) faces an outer peripheral surface of the rotor cylindrical portion 10 with a predetermined clearance therebetween. When the rotor cylindrical portion 10 rotates at high speed, the gas compressed by the vacuum pump 1 is sent out to the outlet port 6 side while being guided by the thread grooves as the rotor cylindrical portion 10 rotates. Specifically, the thread grooves configure a flow path for transporting the gas.

As described above, a gas transfer mechanism for transferring the gas by means of the thread grooves formed on the axial inner peripheral surface of the thread groove exhaust element 20 is configured by allowing the surface of the thread groove exhaust element 20 facing the rotor cylindrical portion 10 to face the rotor cylindrical portion 10 with a predetermined clearance therebetween.

Preferably, the smaller the clearance, the better, in order to reduce the force of the gas flowing back toward the inlet port 4.

The direction of the spiral grooves formed in the thread groove exhaust element 20 is the direction toward the outlet port 6 when the gas is transported through the spiral grooves in the direction of rotation of the rotor 8.

The depth of the spiral grooves is configured to become gradually shallower toward the outlet port 6, so the gas transported through the spiral grooves is compressed as the gas approaches the outlet port 6.

With this configuration described above, the vacuum pump 1 can execute vacuum exhaust processing on a device in which the vacuum pump 1 is fixed (disposed).

Embodiment 1: A contact point of the rotating body (shaft 7 or rotor 8) is configured to have a small resistance FIGS. 2A and 2B are diagrams for explaining an embodiment in which a contact point of the shaft 7 that comes into contact with the protective net 100 is shaped to have a small resistance.

Figure 2B:
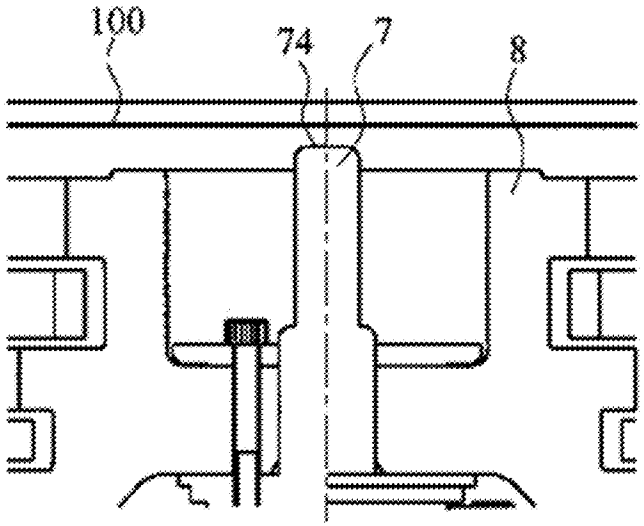
FIGS. 2A and 2B are diagrams for explaining an embodiment in which a contact point of a shaft that comes into contact with a protective net is shaped to have a small resistance.
Figure 2A:
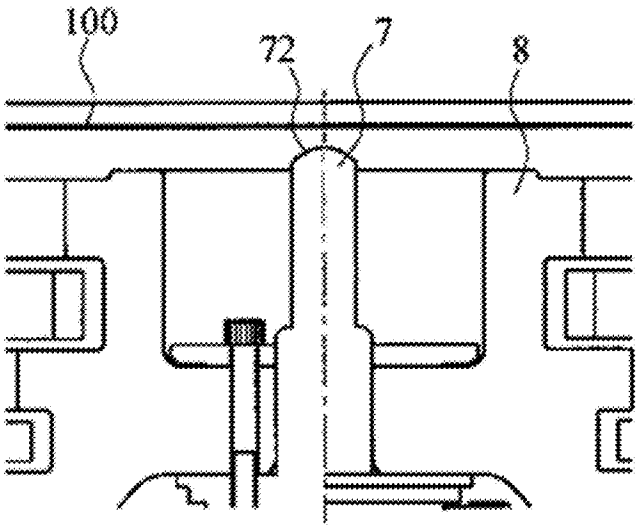

In the embodiment shown in FIGS. 2A and 2B, a tip portion of the shaft 7 that comes into contact with the protective net 100 when the protective net 100 becomes deformed and comes into contact with the shaft 7, is shaped to have a small resistance, thereby supporting the protective net 100 and preventing the protective net 100 from being caught in the shaft 7.

In FIG. 2A, a tip portion 72 of the shaft 7 is in a spherical shape. In FIG. 2B, a tip portion 74 of the shaft 7 is round-chamfered.

Figure 3B:
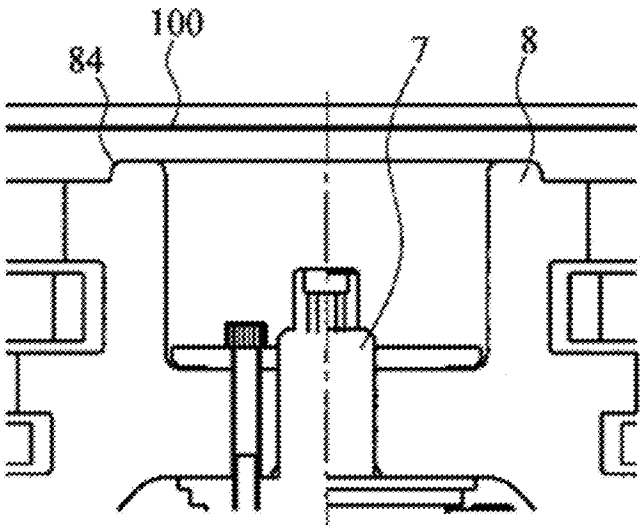
FIGS. 3A and 3B are diagrams for explaining an embodiment in which a contact point of a rotor that comes into contact with the protective net is shaped to have a small resistance.
Figure 3A:
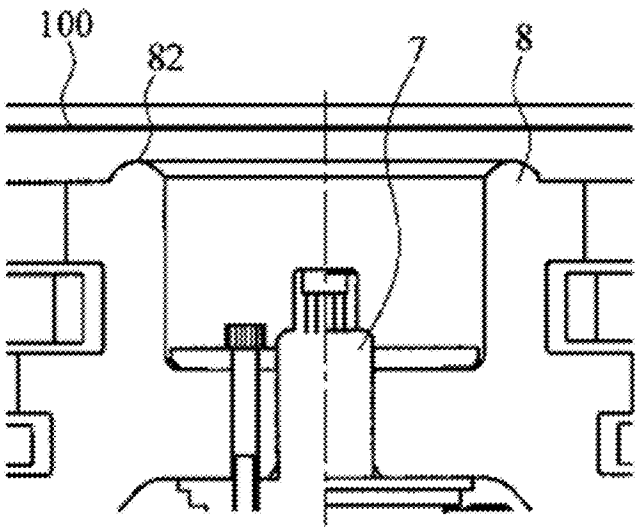

FIGS. 3A and 3B are diagrams for explaining an embodiment in which a contact point of the rotor 8 that comes into contact with the protective net 100 is shaped to have a small resistance.

In the embodiment shown in FIGS. 3A and 3B, a contact portion of the rotor 8 that comes into contact with the protective net 100 when the protective net 100 becomes deformed and comes into contact with the rotor 8, is shaped to have a small resistance, thereby supporting the protective net 100 and preventing the protective net 100 from being caught in the rotor 8.

In FIG. 3A, a contact portion 82 of the rotor 8 is in a spherical shape. In FIG. 3B, a contact portion 84 of the rotor 8 is round-chamfered. In order to obtain these shapes, the rotor 8 may be processed, but these shapes may be formed by attaching ring-like members having said shapes to the rotor 8.

Embodiment 2: A hole is formed in the protective net 100, and the protective net 100 is supported when in contact with the rotating body FIG. 4 is a diagram for explaining an embodiment that forms a hole in the protective net 100 and supports the protective net 100 by bringing the protective net 100 into contact with the rotating body.

In this embodiment, a hole is formed beforehand on a part of the protective net 100 that comes into contact with a protrusion 75 of the shaft 7 or a protrusion 85 of the rotor 8. When the protective net 100 becomes deformed, the protrusion 75 of the shaft 7 and the protrusion 85 of the rotor 8 immediately comes into contact with the hole of the protective net 100 to support the deformation of the protective net 100.

Figure 4B:
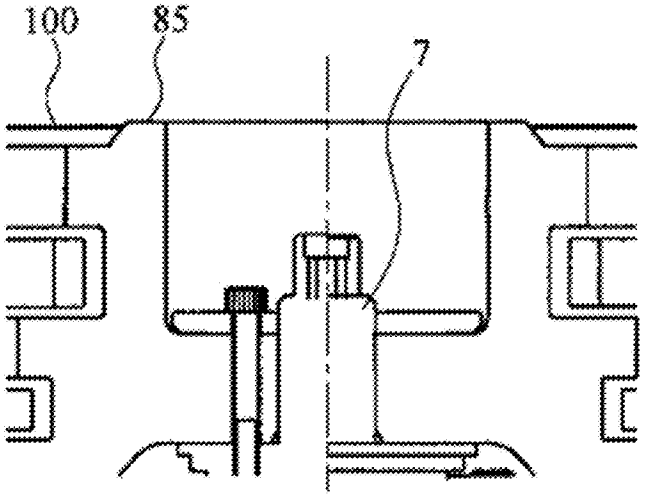
FIGS. 4A and 4B are diagrams for explaining an embodiment that forms a hole in the protective net and supports the protective net by bringing the protective net into contact with a rotating body.
Figure 4A:
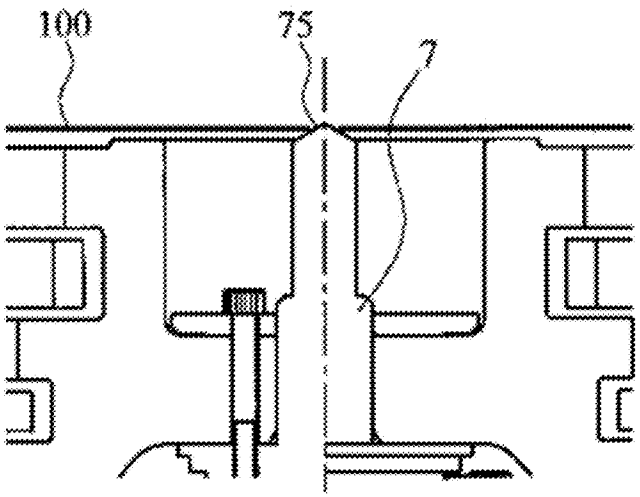

FIG. 4A is a diagram showing an example in which the tapered protrusion 75 is provided on the shaft 7, to support the protective net 100 by coming into contact with the hole of the protective net 100.

FIG. 4B is a diagram showing an example in which the tapered protrusion 85 is provided on the rotor 8, to support the protective net 100 by coming into contact with the hole of the protective net 100.

In order to obtain these shapes, the rotor 8 may be processed, but these shapes may be formed by attaching ring-like members having said shapes to the rotor 8.

In this embodiment, the protective net 100 and the rotating body can be brought closer to each other, further reducing the height (length) of the vacuum pump.

In this embodiment, the gap between the protective net 100 and the rotating body can be reduced by approximately 10 mm. Therefore, when the height of the vacuum pump 1 is 350 mm, the height of the vacuum pump 1 can be reduced to 340 mm.

Figure 5A:
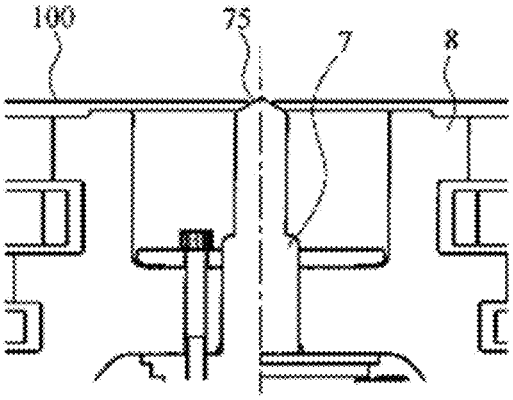
FIGS. 5A to 5C are diagrams showing an example according to Embodiment 2 in which the shape of a protrusion (tip) of the shaft is formed to have a small resistance when in contact with the protective net.
Figure 5B:
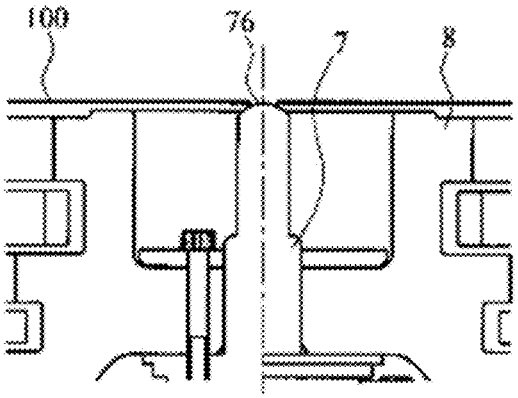
Figure 5C:
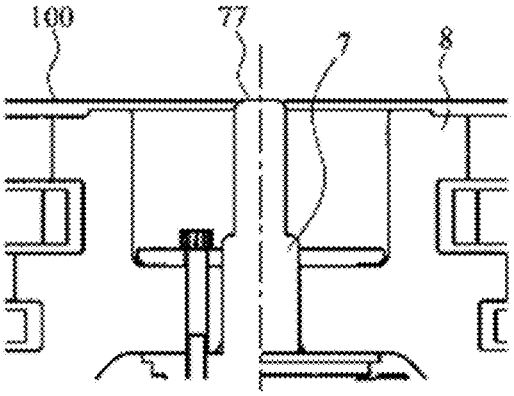

FIGS. 5A to 5C are diagrams showing an example in which the shape of the protrusion (tip) of the shaft 7 is configured to have a small resistance when in contact with the protective net 100 according to Embodiment 2.

In FIG. 5A, the protrusion 75 of the shaft 7 has a tapered shape. Thus, when the shaft 7 comes into contact with the hole of the protective net 100, the resistance therebetween is reduced, so the protective net 100 can be supported by the shaft 7, preventing the protective net 100 from being caught in the shaft 7.

In FIG. 5B, a protrusion 76 of the shaft 7 has a spherical shape. Thus, when the shaft 7 comes into contact with the hole of the protective net 100, the resistance therebetween is reduced, so the protective net 100 can be supported by the shaft 7, preventing the protective net 100 from being caught in the shaft 7.

In FIG. 5C, a protrusion 77 of the shaft 7 is round chamfered. Thus, when the shaft 7 comes into contact with the hole of the protective net 100, the resistance therebetween is reduced, so the protective net 100 can be supported by the shaft 7, preventing the protective net 100 from being caught in the shaft 7.

Figure 6B:
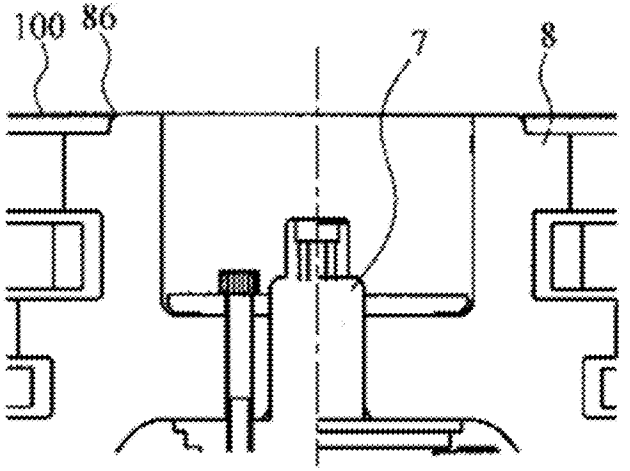
FIGS. 6A and 6B are diagrams showing an example according to Embodiment 2 in which the shape of a protrusion of the rotor is formed to have a small resistance when in contact with the protective net.
Figure 6A:
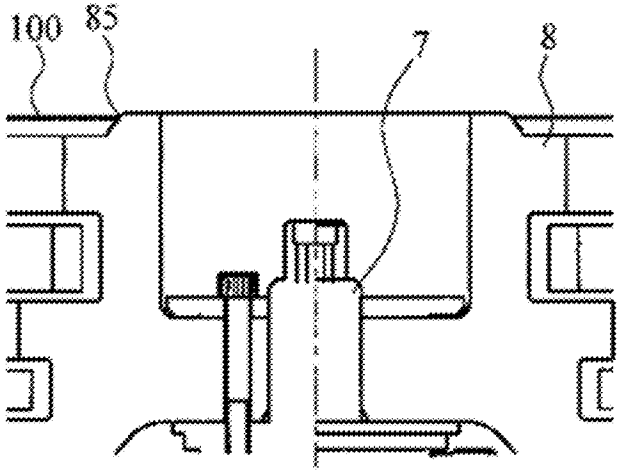

FIGS. 6A and 6B are diagrams showing an example in which the shape of the protrusion of the rotor 8 is configured to have a small resistance when in contact with the protective net 100 according to Embodiment 2.

In FIG. 6A, the protrusion 85 of the rotor 8 has a tapered shape. Thus, when the rotor 8 comes into contact with the hole of the protective net 100, the resistance therebetween is reduced, so the protective net 100 can be supported by the rotor 8, preventing the protective net 100 from being caught in the rotor 8.

In FIG. 6B, a protrusion 86 of the rotor 8 is round chamfered. Thus, when the rotor 8 comes into contact with the hole of the protective net 100, the resistance therebetween is reduced, so the protective net 100 can be supported by the rotor 8, preventing the protective net 100 from being caught in the rotor 8.

Embodiment 3: The contact point of the rotating body (contact portion and protrusion) is configured by a separate member according to Embodiment 1 and Embodiment 2

Figure 7A:
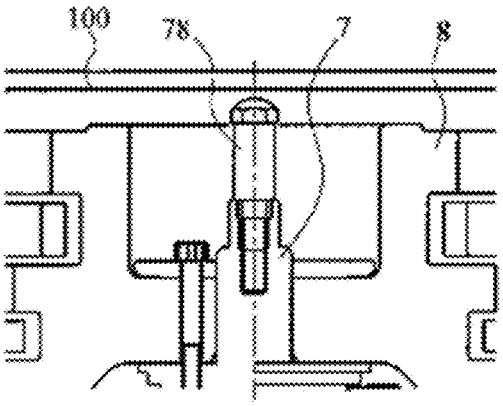
FIGS. 7A to 7C are diagrams
Figure 7B:
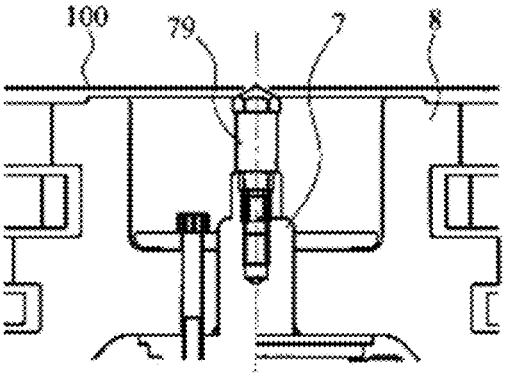
Figure 7C:
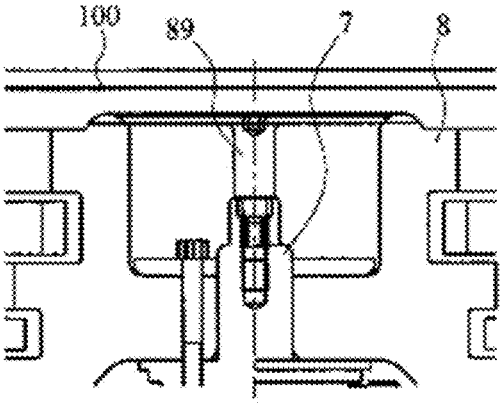

FIGS. 7A to 7C are diagrams for explaining an embodiment in which the contact point (contact portion) of the rotating body of Embodiment 1 and the contact point (protrusion) of Embodiment 2 are configured with separate members.

FIG. 7A is a diagram showing an example in which the tip portion 72 of the shaft 7 of Embodiment 1 shown in FIG. 2A (integrally formed) is configured with a separate member 78.

FIG. 7B is a diagram showing an example in which the protrusion 75 of the shaft 7 of Embodiment 2 shown in FIG. 4A (integrally formed) is configured with a separate member 79.

FIG. 7C is a diagram showing an example in which the contact portion 82 of the rotor 8 of Embodiment 1 shown in FIG. 3A (integrally formed) is configured with a separate member 89.

Configuring the tip portions or protrusions of the rotating body with separate members brings about the effect that the present invention can be implemented by retrofitting the present invention to a conventional product.

Embodiment 4: A friction coefficient reduction process is performed on the part that comes into contact with the protective net 100 according to Embodiment 1 and Embodiment 3

Figure 8B:
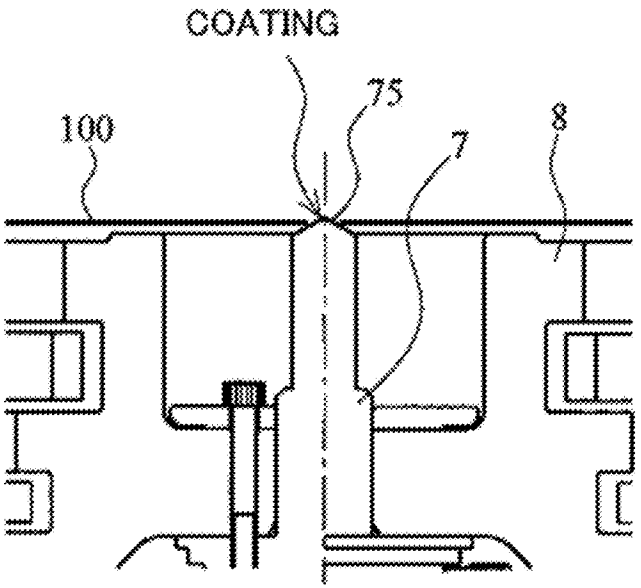
FIGS. 8A and 8B are diagrams for explaining an embodiment in which a process of lowering a friction coefficient is performed on the portions that come into contact with the protective net according to Embodiments 1 to 3.
Figure 8A:
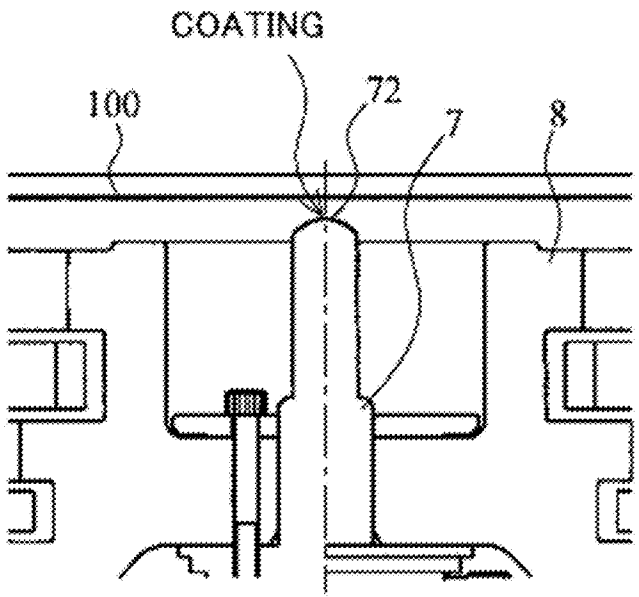

FIG. 8A is a diagram showing an example in which the tip portion 72 of the shaft 7 of the example shown in FIG. 2A of Embodiment 1 is coated to lower a contact friction coefficient. Examples of the coating include plating, PVD (Physical vapor deposition) coating, CVD (Chemical vapor deposition) coating, and the like.

FIG. 8B is a diagram showing an example of lowering a contact friction coefficient when the shaft 7 comes into contact with the protective net 100, by coating the protrusion 75 of the shaft 7 of the example shown in FIG. 5A of Embodiment 2.

By lowering the contact friction coefficient in this manner, the rotating body and the protective net can slide easily on each other when coming into contact with each other, preventing the protective net 100 from being caught in the rotating body.

In the example described above, the coating is applied to the contact portion. However, the protective net 100 may be prevented from being caught in the rotating body, by hardening the contact portion by means of quenching.

Note that the coating may be applied to the contact portion of the protective net 100. The coating may also be applied to both the protrusion 75 of the shaft 7 and the contact portion of the protective net 100.

Embodiment 5: The contact portion of the protective net 100 is formed into a plane FIGS. 9A and 9B are diagrams showing an example in which the part of the protective net 100 that comes into contact with the tip portion 72 of the shaft 7 is formed into a plane 102 according to the example shown in FIG. 2A of Embodiment 1.

Forming the plane means that the base material thereof is left as-is without forming the hexagonal mesh of the protective net 100 (non-mesh portion).

Figure 9A:
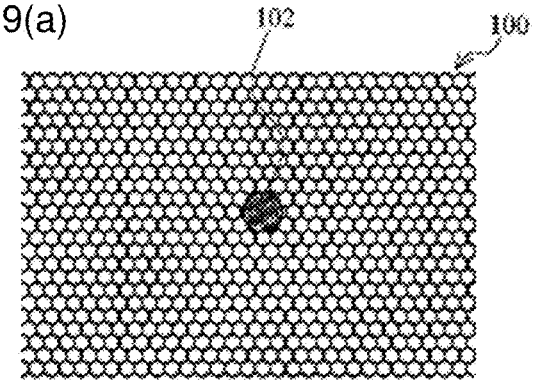
FIGS. 9A and 9B are diagrams showing an example in which the portion of the protective net that comes into contact with the tip portion of the shaft is formed into a plane according to the example shown in FIG. 2A.
Figure 9B:
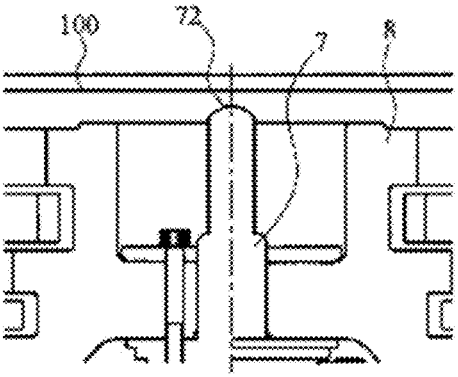

In the example shown in FIGS. 9A and 9B, the part of the protective net 100 that comes into contact with the tip portion 72 of the shaft 7 is formed into the plane 102 without forming the hexagonal mesh therein and by leaving the base material thereof as-is (non-mesh portion).

Forming the plane 102 in the part of the protective net 100 that comes into contact with the rotating body as described above, can prevent the protective net 100 from being caught in the rotating body more effectively.

Figure 10A:
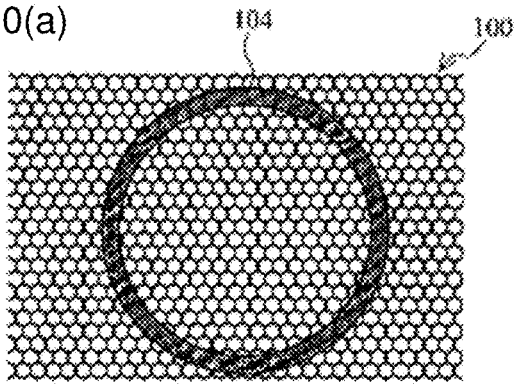
FIGS. 10A and 10B are diagrams showing an example in which the portion of the protective net that comes into contact with the tip portion of the rotor is formed into a plane according to the example shown in FIG. 3A.
Figure 10B:
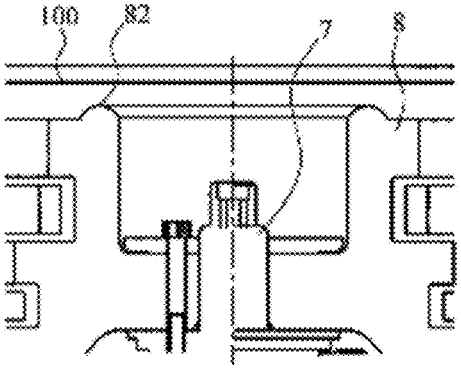

FIGS. 10A and 10B are diagrams showing an example in which the part of the protective net 100 that comes into contact with the tip portion 82 of the rotor 8 is formed into a plane 104 according to the example shown in FIG. 3A of Embodiment 1.

In the example shown FIG. 10A, the part of the protective net 100 that comes into contact with the tip portion 82 of the rotor 8 is formed into the plane 104 without forming the hexagonal mesh therein and by leaving the base material thereof as-is (non-mesh portion). The plane 104 has a circumferential shape in accordance with the rotation of the rotor 8 (tip portion 82).

Forming the plane 104 in the part of the protective net 100 that comes into contact with the rotating body as described above, can prevent the protective net 100 from being caught in the rotating body more effectively.

Embodiment 6: The shape of the hole of the protective net 100 that comes into contact with the rotating body is configured to narrow the contact point according to Embodiment 2

Figure 11B:
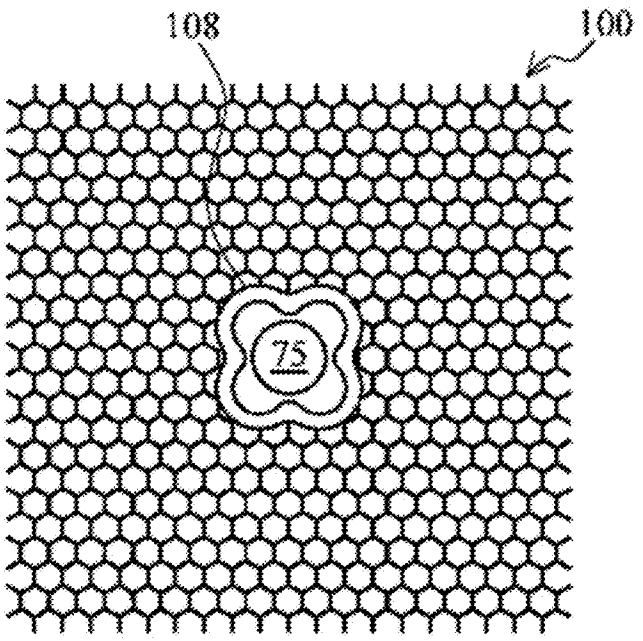
FIGS. 11A and 11B are diagrams showing an example in which the hole in the protective net that comes into contact with the contact point is configured to narrow the contact point according to the example shown in FIG. 4A.
Figure 11A:
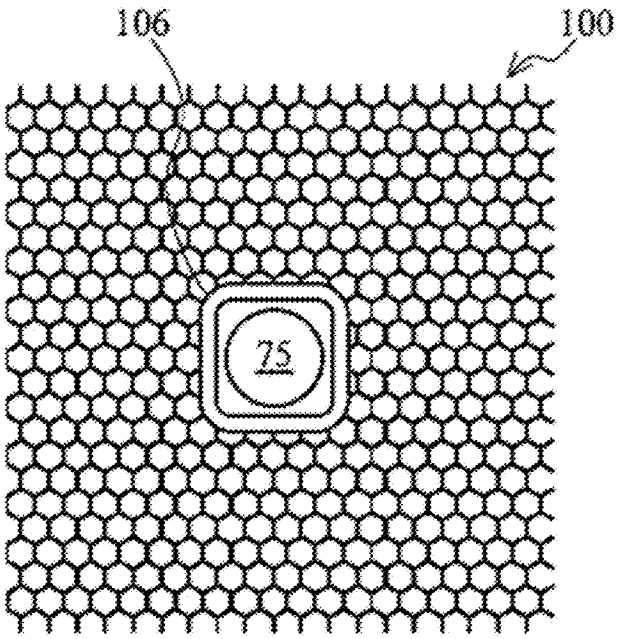

FIG. 11A is a diagram showing an example in which the shape of the part of the protective net 100 that comes into contact with the rotating body is formed into substantially a square (106) (non-mesh portion) according to the example shown in FIG. 4A.

FIG. 11B is a diagram showing an example in which the shape of the part of the protective net 100 that comes into contact with the rotating body is configured into a shape (108) in which the four sides of the substantially square shape is recessed (non-mesh portion) according to the example shown in FIG. 4A.

As shown in FIGS. 11A and 11B, since the horizontal cross-sectional shape of the protrusion 75 of the shaft 7 that comes into contact with the protective net 100 is a circular shape, the shape of the part of the protective net 100 that comes into contact with the protrusion 75 is formed into a non-circular shape. Therefore, compared to when the shape of the part of the protective net 100 is formed into a circular shape, the contact point can be reduced, preventing the entanglement of the protective net 100 more effectively.

The shape of the hole may be a polygonal shape or a corrugated circular shape.

Embodiment 7: The protective net 100 is provided with a part that comes into contact with the rotating body at the time of deformation of the protective net 100

Figure 12B:
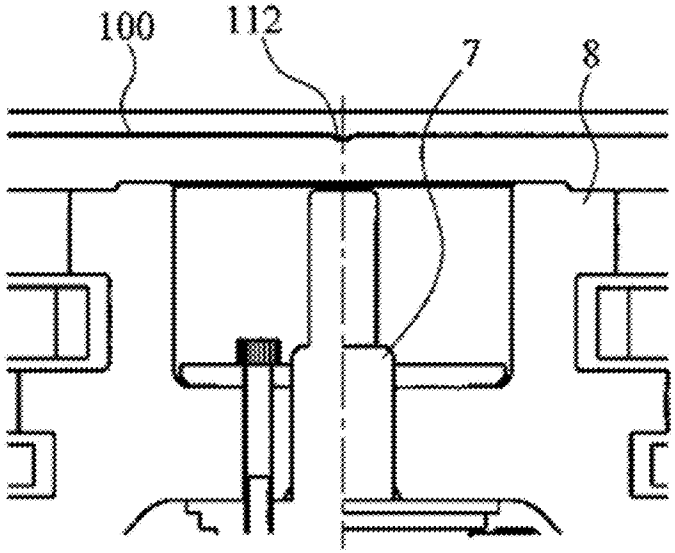
FIGS. 12A and 12B are diagrams showing an example in which the portion of the protective net that comes into contact with the rotating body when the protective net is deformed is provided with a contact protrusion.
Figure 12A:
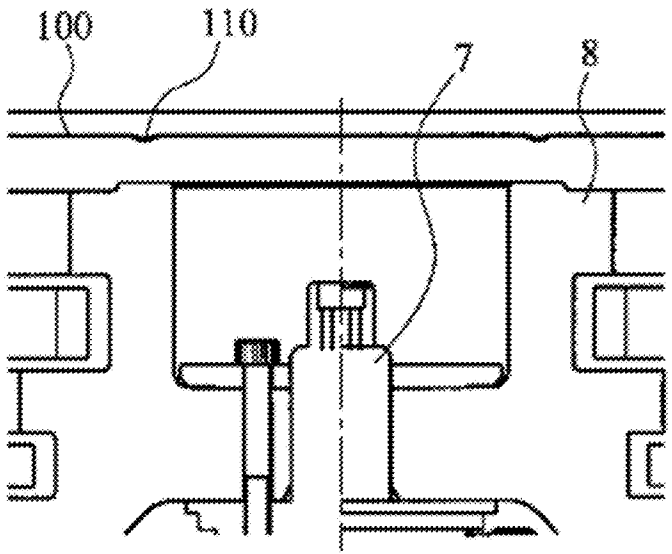

FIG. 12A is a diagram showing an example in which a contact protrusion 110 is provided in the part of the protective net 100 that comes into contact with the rotor 8 at the time of deformation of the protective net 100.

FIG. 12B is a diagram showing an example in which a contact protrusion 112 is provided in a part of the protective net 100 that comes into contact with the shaft 7 at the time of deformation of the protective net 100.

The contact protrusions 110, 112 are formed by deforming the protective net 100 using a mold, a tool, or the like.

By providing the protective net 100 with the contact protrusions 110, 112 (non-mesh portions) as described above, when the protective net 100 becomes deformed and consequently the contact protrusions 110, 112 come into contact with the rotating body, the protective net 100 can be supported, preventing the entanglement of the protective net 100.

Figure 13B:
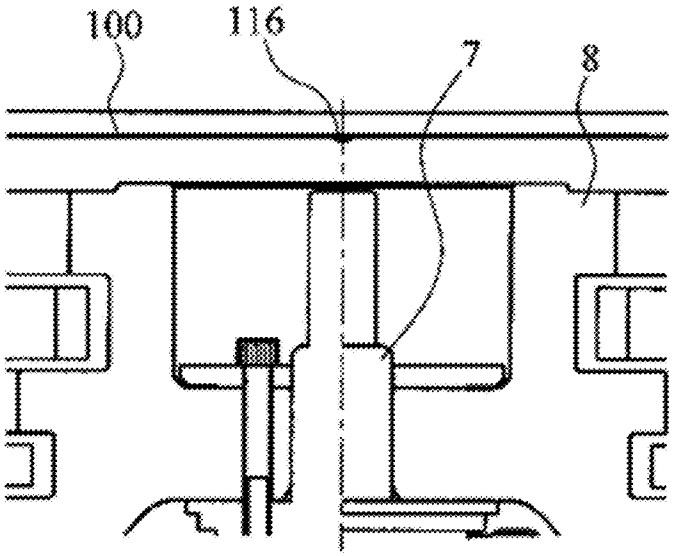
FIGS. 13A and 13B are diagrams showing an example in which the portion of the protective net that comes into contact with the rotating body when the protective net is deformed is provided with a welding protrusion.
Figure 13A:
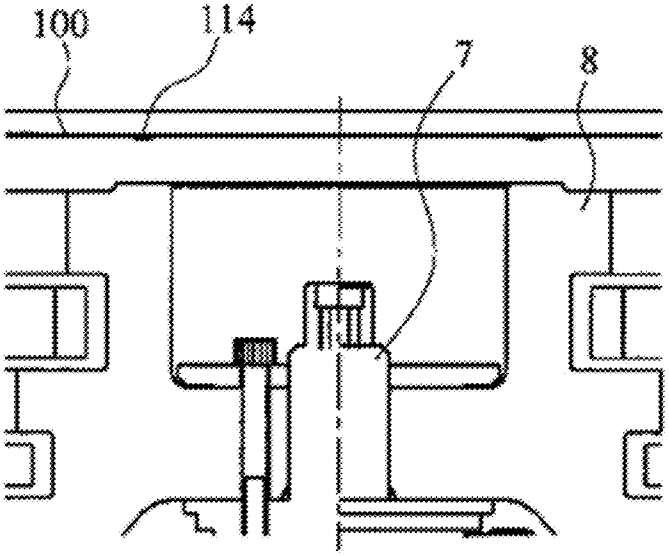

FIG. 13A is a diagram showing an example in which a welding protrusion 114 is provided in the part of the protective net 100 that comes into contact with the rotor 8 at the time of deformation of the protective net 100.

FIG. 13B is a diagram showing an example in which a welding protrusion 116 is provided in the part of the protective net 100 that comes into contact with the shaft 7 at the time of deformation of the protective net 100.

The welding protrusions 114, 116 (non-mesh portions) are formed by joining the protective net 100 to separate parts by means of welding or the like.

By providing the protective net 100 with the welding protrusions 114, 116 (non-mesh portions) as described above, when the protective net 100 becomes deformed and consequently the welding protrusions 114, 116 come into contact with the rotating body, the protective net 100 can be supported, preventing the entanglement of the protective net 100.

The example shown in Embodiment 7 may be combined with, for example, the process performed on the rotating body of the vacuum pump 1 shown in Embodiment 1.

Embodiment 8: When forming the hole in the protective net 100, the distance between the hole of the protective net 100 and the protrusion 75 of the shaft 7 or the protrusions 85 of the rotor 8 is made smaller than the mesh of the protective net 100 according to Embodiment 2

Figure 14A:
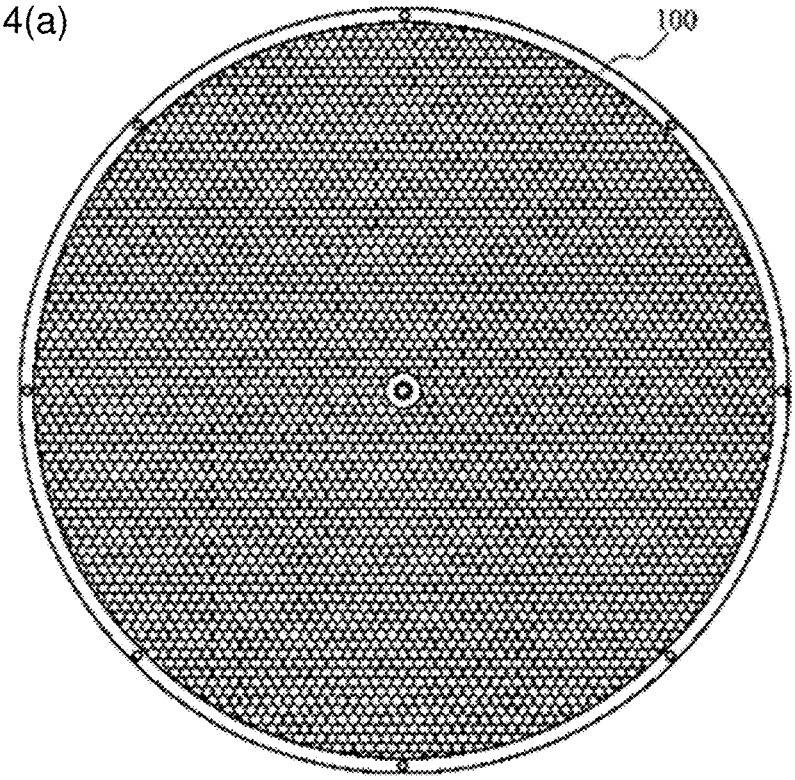
FIGS. 14A and 14B are diagrams showing, in more detail, the relationship between the protrusion of the shaft and the hole of the protective net according to the example shown in FIG. 5A.
Figure 14B:
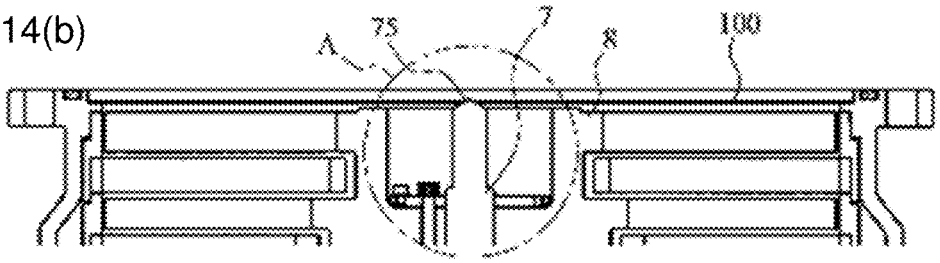

FIGS. 14A and 14B are diagrams showing, in more detail, the relationship between the protrusion 75 of the shaft 7 of the example shown in FIG. 5A and the hole of the protective net 100. FIG. 14A shows the mesh of the protective net 100.

Figure 15:
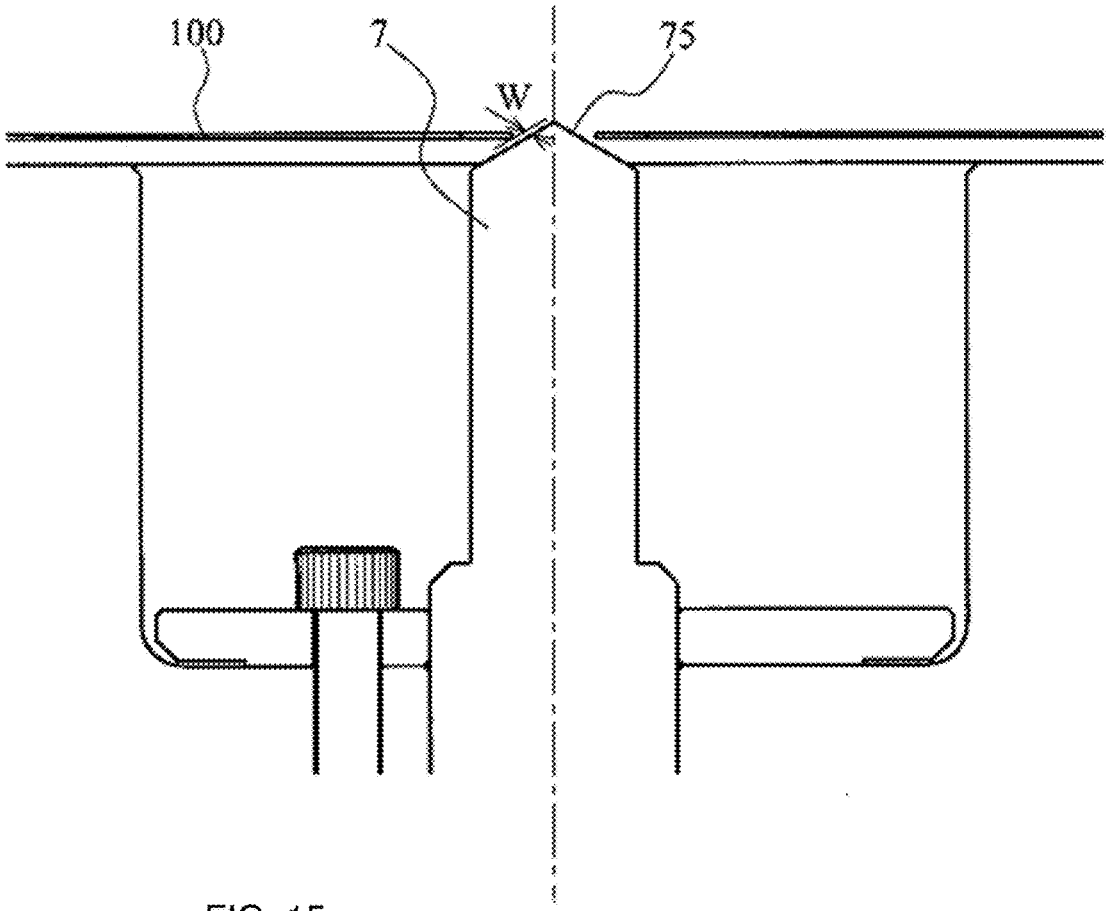
FIG. 15 is an enlarged view of the portion indicated by "A" in FIG. 14B.
Figure 16A:
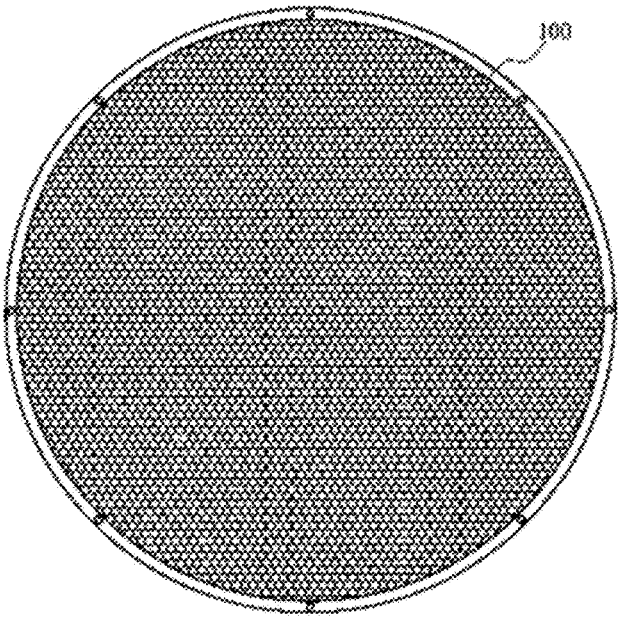
FIGS. 16A and 16B are diagrams for explaining how the protective net is installed in the vacuum pump according to the prior art.
Figure 16B:
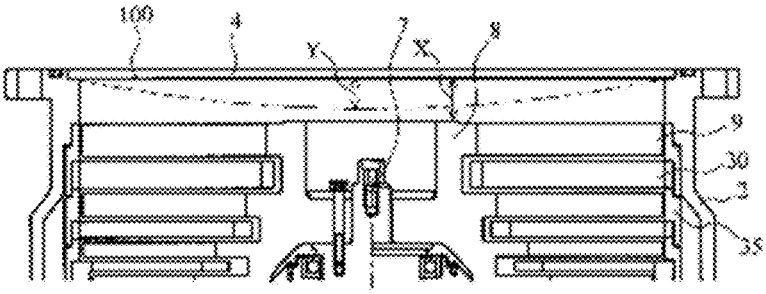

FIG. 15 is an enlarged view of the part indicated by "A" in FIG. 14B.

As shown in FIG. 15, a distance W between the protrusion 75 of the shaft 7 and the protective net 100 is set to be smaller than the mesh of the protective net 100.

In this manner, even when the hole is formed in the protective net 100, entry of foreign matter can be prevented. Specifically, as with the configuration in which the protective net 100 is present in the entire section, the same effect can be achieved.

The embodiments of the present invention and each of the modifications of the present invention may be combined as needed.

Although the above has described that the shape of the mesh of the protective net 100 is a hexagonal shape, the shape of the mesh of the protective net 100 is not limited thereto; needless to say, the same effect can be achieved with another polygonal shape or a round shape.

Various modifications can be made to the present invention without departing from the spirit of the present invention. Moreover, it goes without saying that the present invention extends to such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a housing in which an inlet port is formed;

a protective net provided at the inlet port;

a gas transfer mechanism provided with a rotating body in the housing; and an entanglement prevention mechanism that prevents the protective net from being caught in the rotating body when the protective net is deformed, wherein the entanglement prevention mechanism is a non-mesh portion that is formed in a part of the protective net that comes into contact with a part of the rotating body, by leaving a base material, wherein only the non-mesh portion comes in contact with the part of the rotating body.

2. The vacuum pump according to claim 1, wherein the part of the rotating body that comes into contact with the protective net has a shape having a small contact resistance.

3. The vacuum pump according to claim 2, wherein the shape having the small contact resistance is provided on a shaft of the rotating body.

4. The vacuum pump according to claim 2, wherein the shape having the small contact resistance is provided on a rotor of the rotating body.

5. The vacuum pump according to claim 1, wherein the part of the rotating body that comes into contact with the non-mesh portion is coated so as to lower a friction coefficient.

* * * * *